US007603943B2

(12) United States Patent
Haas et al.

(10) Patent No.: US 7,603,943 B2
(45) Date of Patent: Oct. 20, 2009

(54) LINEAR ACTUATOR FOR ROTATING SHAFT ASSEMBLIES

(75) Inventors: Gene F. Haas, Camarillo, CA (US); John W. Ryan, Carpenteria, CA (US); Nicholas M. Rocksvold, Santa Paula, CA (US); William F. Tandrow, Simi Valley, CA (US)

(73) Assignee: Haas Automation, Inc., Oxnard, CA (US)

( * ) Notice: Subject to any disclaimer, the term of this patent is extended or adjusted under 35 U.S.C. 154(b) by 268 days.

(21) Appl. No.: 11/706,555

(22) Filed: Feb. 14, 2007

(65) Prior Publication Data

US 2008/0190280 A1 Aug. 14, 2008

(51) Int. Cl.
*F01B 31/00* (2006.01)
*B21B 31/30* (2006.01)

(52) U.S. Cl. ..... 92/110; 279/4.01

(58) Field of Classification Search ..... 92/110, 92/54, 55; 91/392, 197; 279/4.01
See application file for complete search history.

(56) References Cited

U.S. PATENT DOCUMENTS 2,679,233 A * 5/1954 Liaaen ..... 92/54
4,945,819 A * 8/1990 Rohm ..... 92/110
5,501,137 A * 3/1996 Weichler ..... 92/54
6,257,122 B1 * 7/2001 Michler et al. ..... 92/110
6,487,957 B2 * 12/2002 Colimitra ..... 92/54

* cited by examiner

*Primary Examiner*—Thomas E Lazo
(74) *Attorney, Agent, or Firm*—McDermott Will & Emery LLP

(57) ABSTRACT

A linear actuator for a rotating shaft assembly includes a cylinder and a piston arranged within a cavity defined by the cylinder. Faces of the piston delimit first and second chambers within the cavity. A rotatable shaft fixed to the piston defines a first main passage in fluid communication with the first chamber and a second main passage in fluid communication with the second chamber. A pressure delivery body rotatably fixed to the rotatable shaft defines a first delivery passage in fluid communication with the first main passage and a second delivery passage in fluid communication with the second main passage. A passage isolation system selectively isolates fluid communication between the first delivery passage and the first main passage and fluid communication between the second delivery passage and the second main passage. A pressure limiting system selectively blocks fluid communication through the first and second main passages.

14 Claims, 10 Drawing Sheets

LINEAR ACTUATOR FOR ROTATING SHAFT ASSEMBLIES

BACKGROUND OF THE INVENTION

The present invention concerns linear actuators, and more particularly linear actuators for use with rotating shaft assemblies.

Linear actuators provide a linear range of motion and force useful in a number of applications. For example, linear actuators are often used to position and/or clamp work pieces in machine tools. Certain applications require the linear actuator to accommodate a rotatable shaft. For example, some lathe machine tools attach a chuck to a rotatable shaft actuated by a linear actuator. Using the linear actuator and chuck, a work piece is positioned and clamped in the lathe machine tool while it is rotated during the machining process. The rotation of the shaft, however, presents challenges to the design and operation of the linear actuator.

Linear actuators are typically operated using either mechanical systems (stepper motors, gears, springs, etc.) or pressurized fluid systems (gas or liquid). Many mechanical systems cannot be adapted for use with rotating shaft assemblies. Those systems which can be adapted for rotating shaft assemblies are typically overly complex and expensive. Additionally, mechanical systems usually have limited, if any, capability to adjust and apply different amounts of force for different applications.

Pressurized fluid systems provide their own set of challenges for applications involving rotating shaft assemblies. Conventional pressurized fluid systems rely on a constant delivery of pressurized fluid to the rotating components to maintain the pressure required to actuate the rotating shaft components. This delivery is generally accomplished using a rotary union, or similar structure, in which the pressurized fluid is supplied to a relatively fixed structure that surrounds a portion of a rotating structure. The rotary union delivers the pressurized fluid through passages that are isolated by a relatively small gap between the outer surface of the rotating structure and the adjacent inner surface of the stationary structure. This gap in conventional rotary unions results in fluid leakage and pressure loss. Fluid shear from passing through the small clearance generates excessive heat. The small clearance requires constant lubrication and is subject to fluid contamination in the rotary union which can lead to device failure. The need for lubrication and the pressure loss are the reasons conventional units require a constant delivery of pressurized fluid. Placing pressure seals between the stationary and rotating structures to prevent leakage and avoid contamination still results in heat build-up as well as excessive wear on the components due to the constant contact between the rotating and fixed structures.

A need exists for a linear actuator for use with rotating shaft assemblies that has the ability to deliver and maintain fluid pressure in selectable amounts without requiring the fluid pressure source to remain in contact with the rotating shaft while it is rotating.

BRIEF SUMMARY OF THE INVENTION

The invention addresses the foregoing problems by providing a linear actuator that is capable of actuating a rotatable shaft by delivering pressurized fluid between rotating components and a non-rotating pressure supply body without requiring constant pressure delivery between the rotating and non-rotating components. To deliver pressurized fluid to the rotating components, the rotation is stopped and seals are temporarily engaged between the rotating components and the non-rotating pressure supply body. Once the pressurized fluid has been delivered, the seals' contact between the rotating components and the pressure supply body is disengaged thereby allowing the rotating components to spin substantially free of contact with the seals. Fluid pressurization is maintained within the rotating components using valves that are opened during pressure delivery and closed before the seals are disengaged.

According to one aspect of the invention, a linear actuator for a rotating shaft assembly is provided that includes a cylinder member and a primary piston arranged within a cavity defined by the cylinder member. A first face of the primary piston delimits a first chamber within the cavity and a second face of the primary piston delimits a second chamber within the cavity. A rotatable shaft is fixed to the primary piston and defines a first main passage in fluid communication with the first chamber and a second main passage in fluid communication with the second chamber. A pressure delivery body is rotatably fixed to the rotatable shaft and defines a first delivery passage in fluid communication with the first main passage and a second delivery passage in fluid communication with the second main passage. The pressure delivery body further includes a passage isolation system for selectively isolating fluid communication between the first delivery passage and the first main passage and fluid communication between the second delivery passage and the second main passage. A pressure limiting system is employed for selectively blocking fluid communication through the first main passage and the second main passage.

The linear actuator is arranged such that the cylinder member, the primary piston and the rotatable shaft are rotationally movable with respect to the pressure delivery body. In addition, the primary piston, the rotatable shaft and the pressure delivery body are axially movable with respect to the cylinder member.

In operation, the linear actuator actuates the rotatable shaft in a first axial direction upon fluid pressurization of the first chamber. Similarly, fluid pressurization of the second chamber actuates the rotatable shaft in a second axial direction. Blocking fluid communication through the first and second main passages substantially maintains the actuation of the rotatable shaft.

The present invention provides significant advantages over conventional devices. By using seals that can be selectively engaged between rotating and non-rotating components, larger clearances can be maintained between the components. This results in less heat build-up and a reduction in the associated thermal distortion generated in moving components. Larger clearances also reduces or removes the need for additional lubrication between the component surfaces. The ability to maintain fluid pressurization in the rotating components yields significant advantages as well. This allows the pressure supply to be disconnected while the rotatable shaft is rotating, which minimizes or prevents fluid leakage from the clearance gap between the rotating and non-rotating components. Other advantages and benefits will become apparent to those skilled in the art after reading the detailed description provided below.

The foregoing summary of the invention has been provided so that the nature of the invention can be understood quickly. A more detailed and complete understanding of the preferred embodiments of the invention can be obtained by reference to the following detailed description of the invention together with the associated drawings.

DETAILED DESCRIPTION OF THE INVENTION

The detailed description of the invention set forth below in connection with the associated drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without all of the specific details contained herein. In some instances, well known structures and components are described more generally in order to avoid obscuring the concepts of the invention.

Figure 1:
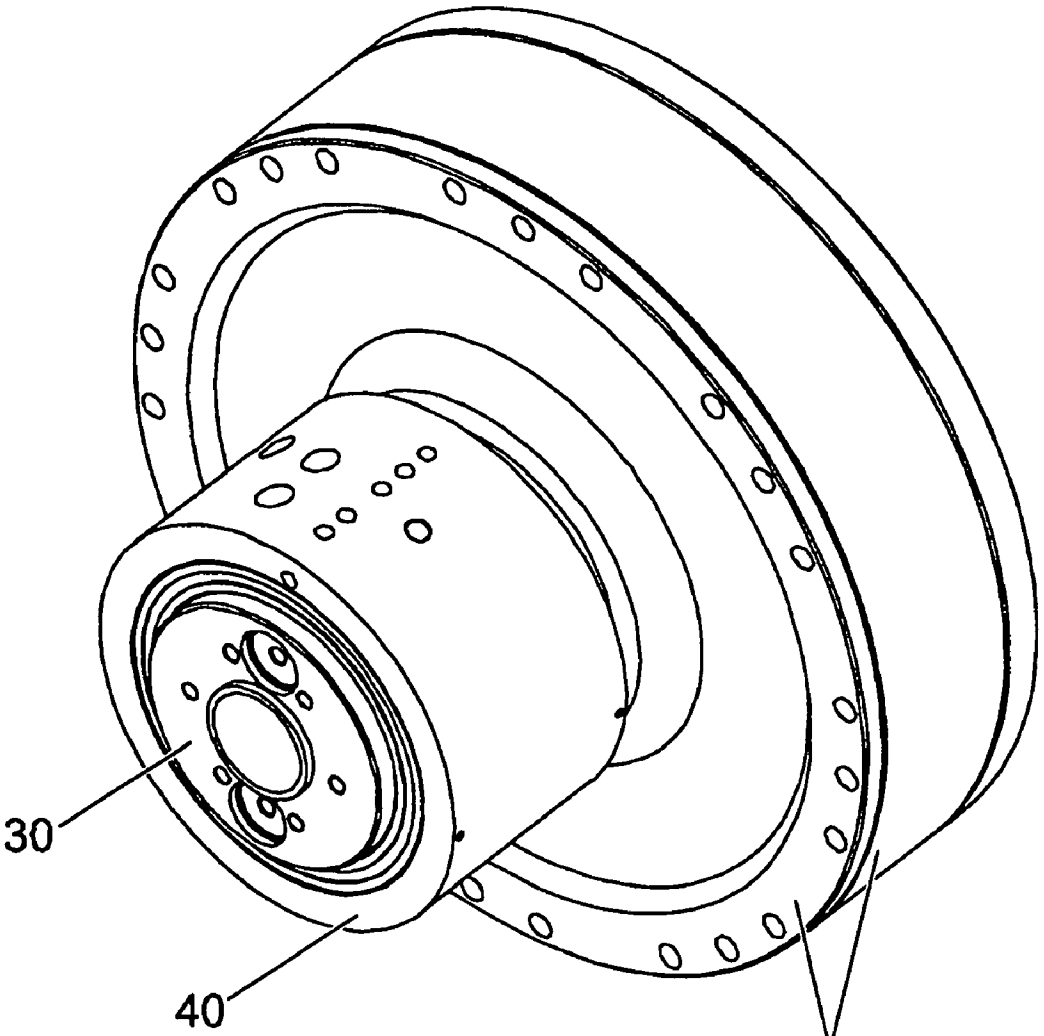
FIG. 1 is an isometric view of a linear actuator according to one embodiment of the invention.

FIG. 1 is an isometric view of a linear actuator 10 according to one embodiment of the invention. As depicted in FIG. 1, linear actuator 10 includes a cylinder member 20, a rotatable shaft 30 and a pressure delivery body 40. Briefly, cylinder member 20 defines a cavity in which a primary piston (not shown) is arranged and driven in an axial direction by pressurized fluids supplied via pressure delivery body 40. Rotatable shaft 30 is fixed to the primary piston and is linearly actuated by driving the primary piston within cylinder member 20. A more detailed description of the linear actuator 10 and its operation is provided below.

Figure 2:
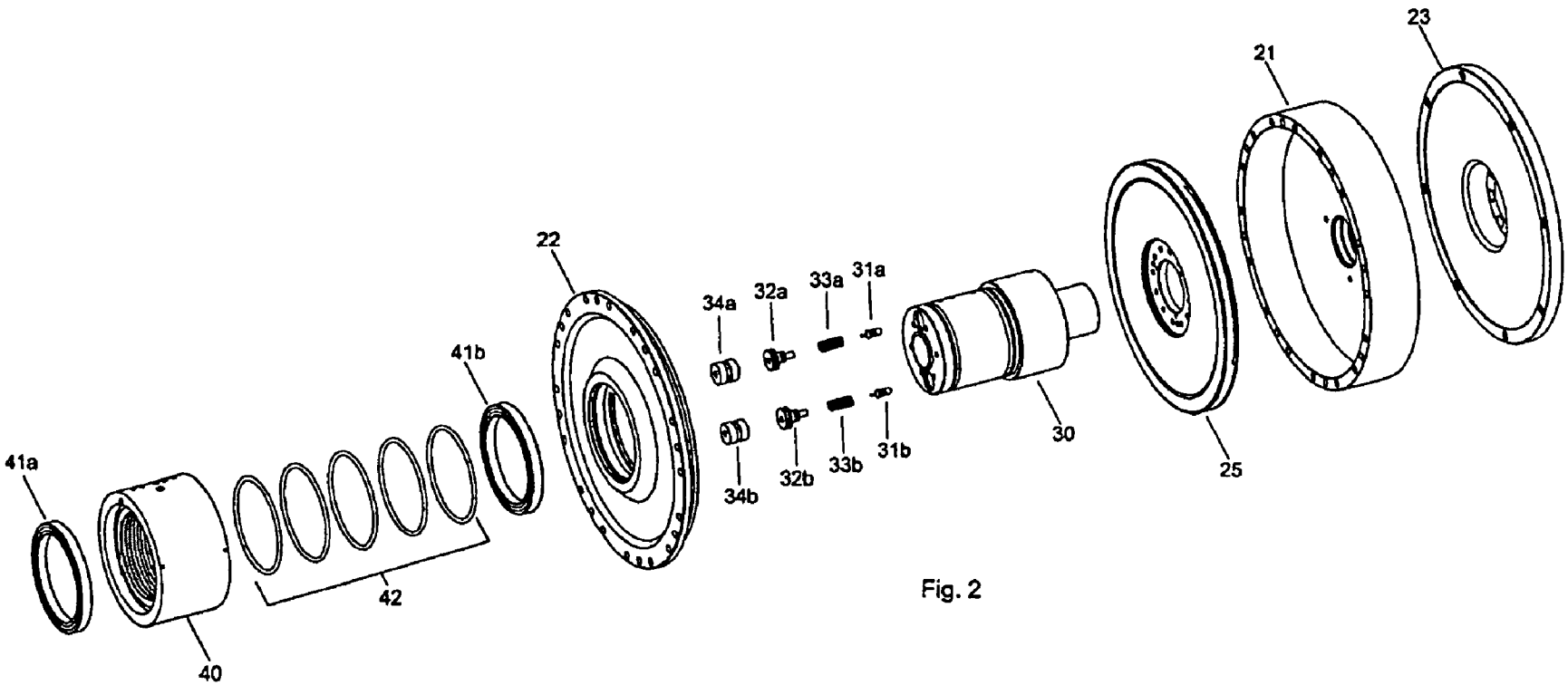
FIG. 2 is an exploded view of a linear actuator according to one embodiment of the invention.

FIG. 2 is an exploded view of linear actuator 10 illustrating individual components of linear actuator 10 according to one embodiment of the invention. FIG. 2 depicts a cylinder wall 21 and a cylinder base 22, which form cylinder member 20. Primary piston 25 is arranged within the cavity defined by cylinder member 20 and is axially movable with respect to cylinder member 20. The opposing faces of primary piston 25 delimit respective chambers within the cavity which are used to drive primary piston 25 in an axial direction.

Rotatable shaft 30 defines a pair of internal main passages which are in fluid communication with respective ones of the chambers delimited by primary piston 25. A pressure limiting system is arranged within the main passages. According to one embodiment of the invention, the pressure limiting system includes valves 31*a* and 31*b*, actuating pistons 32*a* and 32*b* and return springs 33*a* and 33*b*. End caps 34*a* and 34*b* seal a proximal end of each of the main passages within rotatable shaft 30. Valves 31*a* and 31*b* are used to control fluid communication through the main passages defined within rotatable shaft 30. Valves 31*a* and 31*b* are opened and closed using actuators comprising actuating pistons 32*a* and 32*b* and return springs 33*a* and 33*b*.

Pressure delivery body 40 defines a cylindrical opening configured to receive an end portion of rotatable shaft 30. A series of ring grooves are formed on an inner circumferential wall of pressure deliver body 40 and are each in fluid communication with at least one delivery passage or vent defined within pressure delivery body 40. Isolation seals 42 are arranged within alternating ring grooves as part of a passage isolation system. Applying a pressurized fluid to the connected delivery passage compresses isolation seals 42 against the outer circumferential surface of the rototable shaft 30. In their compressed state, isolation seals 42 isolate the alternating empty ring grooves from one another so they can be used to deliver pressurized fluids to other components of linear actuator 10, as will be described in more detail below. Pressure delivery body 40 is rotatably attached to rotatable shaft 30 using bearings 41*a* and 41*b* installed in opposite ends of pressure delivery body 40.

Figure 3:
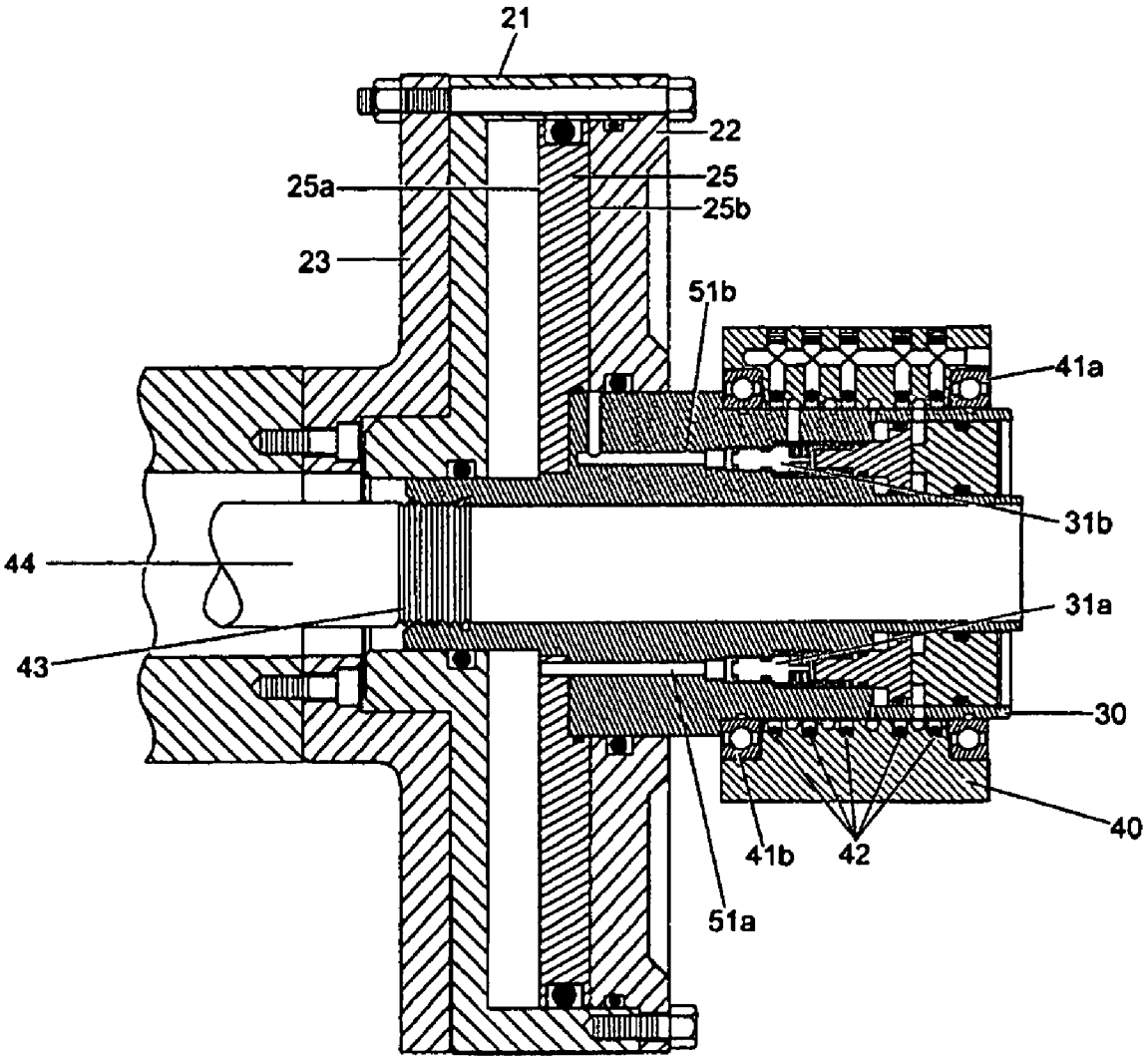
FIG. 3 is cross-sectional view of a linear actuator according to one embodiment of the invention.

Also depicted in FIG. 2 is a cylinder mounting adaptor 23. Cylinder mounting adapter 23 facilitates the attachment of linear actuator 10 to a machine tool. Attachment can be achieved using any of a number of connection means known to those skilled in the art. For example, as depicted in FIG. 3, cylinder mounting adapter 23 is bolted to cylinder member 20 on one face and to a second structure of the machine tool on a second face. Furthermore, the shape of cylinder mounting adapter 23 is not limited to the shape depicted in FIGS. 2 and 3. Alternative shapes and connection means may be employed to adapt linear actuator 10 to a number of different machine tools without departing from the scope of the invention.

FIGS. 1 and 2, and their associated descriptions above, have been provided to introduce the primary components of linear actuator 10. A more detailed description of the operation of linear actuator 10 now will be provided with reference to FIGS. 3 to 9, in which common components have been labeled with common reference numbers.

FIG. 3 is a cross-sectional view of linear actuator 10 according to one embodiment of the invention. The configuration depicted in FIG. 3 reflects the components of linear actuator 10 in an initial state. As shown in FIG. 3, primary piston 25 is positioned within the cavity defined by cylinder member 20 so that a first chamber within the cavity delimited by a first face 25*a* of primary piston 25 is maximized while a second chamber within the cavity delimited by a second face 25*b* of primary piston 25 is minimized.

Rotatable shaft 30 extends through an axial opening in cylinder base 22 and into the cavity defined by cylinder member 20. Within the cavity, rotatable shaft 30 extends through and is fixed to an axial opening in primary piston 25. Rotatable shaft 30 can be fixed to primary piston 25 using any of a number of known techniques. For example, rotatable shaft 30 can be welded to primary piston 25 or pressure fitted into the axial opening of primary piston 25. Rotatable shaft 30 then exits the cavity through an axial opening in cylinder wall 21.

Rotatable shaft 30 defines two main passages 51*a* and 51*b*. Main passage 51*a* is in fluid communication with the first chamber delimited by the first face 25*a* of primary piston 25. Main passage 51*b* is in fluid communication with the second chamber delimited by the second face 25*b* of primary piston 25. Fluid communication through main passages 51*a* and 51*b* is controlled using a pressure limiting system that includes valves 31*a* and 31*b*. When valves 31*a* and 31*b* are closed, fluid communication through main passages 51*a* and 51*b* is blocked, thereby substantially maintaining any fluid pressurization in the two chambers delimited by primary piston 25. When valves 31*a* and 31*b* are open, fluid communication through main passages 51*a* and 51*b* is facilitated, thereby allowing the fluid pressurization of the two chambers to be changed. In the initial state, valves 31*a* and 31*b* are closed.

Rotatable shaft 30 is rotatably fixed to pressure delivery body 40 with bearings 41*a* and 41*b*. Bearings 41*a* and 41*b* allow rotatable shaft 30 to rotate within the cylindrical opening defined by pressure delivery body 40. As indicated above, a series of ring grooves are formed in the inner circumferential surface of pressure delivery body 40. As shown in FIG. 3, isolation seals 42 are placed in alternating ring grooves. In the initial state, isolation seals 42 are in expanded form and are withdrawn into the ring grooves away from contact with the outer circumferential surface of rotatable shaft 30. In this state, rotatable shaft 30, together with primary piston 25 and cylinder member 20, is free to rotate on bearings 41*a* and 41*b* within pressure delivery body 40 without isolation seals 42 being in contact with rotatable shaft 30. The clearance between the adjacent surfaces of rotatable shaft 30 and pressure delivery body 40 is generally between 0.010" and 0.120" depending on the type of isolation seal used. Accordingly, there is no need for lubrication to be applied directly between the adjacent surfaces of rotatable shaft 30 and pressure delivery body 40.

Rotatable shaft 30 further defines a mount 43 for attaching and securing a rotatable shaft component 44 at a distal end. Rotatable shaft component 44 is typically a device for securing a work piece as it is rotated in a machine tool. Such devices include, but are not limited to, chucks, collets and custom designed work-holding devices. As shown in FIG. 3, mount 43 is a threaded receptacle arranged to receive rotatable shaft component 44 by threading the component into the receptacle. The invention is not limited to this type of mount and may include any industry standard or custom designed mounts known to those skilled in the art without departing from the scope of the invention.

Figure 4:
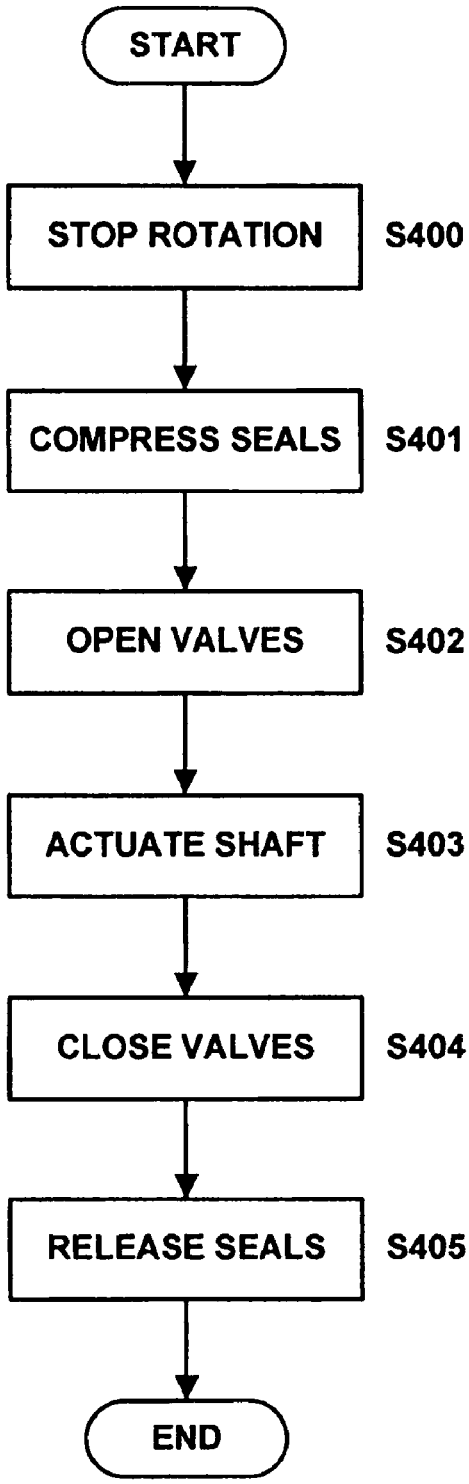
FIG. 4 is a flowchart representing the operational steps of one embodiment of the present invention.

FIG. 4 is a flowchart depicting operating steps of linear actuator 10 according to one embodiment of the invention. The operation starts with linear actuator 10 in the initial state described above. In step S400, any rotation of rotatable shaft 30 is stopped in preparation for passage isolation and fluid pressurization. In step S401, isolation seals 42 are compressed to isolate delivery passages within pressure delivery body 40. In step S402, valves 31*a* and 31*b* are opened to allow fluid communication through main passages 51*a* and 51*b*, respectively. In step S403, rotatable shaft 30 is actuated. In step S404, valves 31*a* and 31*b* are closed to block fluid communication through main passages 51*a* and 51*b*, respectively. In step S405, isolation seals 42 are released. Each of these steps will now be described in more detail.

As mentioned above, step S400 involves stopping the any rotation of rotatable shaft 30. The rotation of rotatable shaft 30 is stopped in order to prevent damage, heat build-up and excessive wear to the various components of linear actuator 10 as isolation seals are brought into contact with the outer circumferential surface of rotatable shaft 30. In general, rotation of rotatable shaft 30 is stopped by disengaging the driving mechanism within the machine tool and allowing the rotation movement to cease. For example, the spindle in lathe applications can be disengaged to stop rotation. In addition to relying on the inherent friction within the machine tool to stop rotation, any of a number of braking mechanisms known to those skilled in the art can be used.

Figure 5:
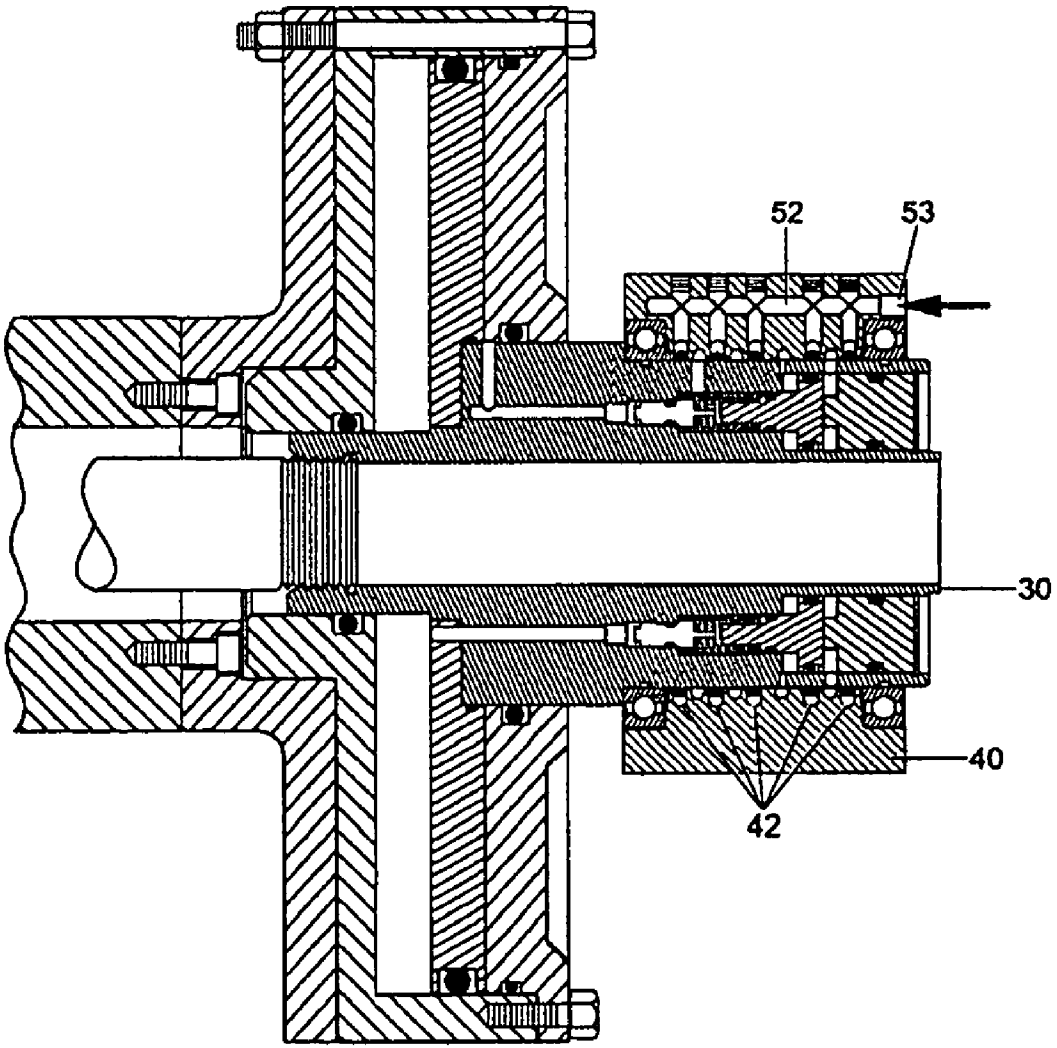
FIG. 5 is cross-sectional view of a linear actuator according to one embodiment of the invention.

FIG. 5 is a cross-sectional view of linear actuator 10 depicting the compression of isolation seals 42 according to one embodiment of the invention (step S401). As shown in FIG. 5, pressure delivery body 40 defines a delivery passage 52 which is in fluid communication with each of the ring grooves housing isolation seals 42. Specifically, delivery passage 52 includes a series of passages that intersect respective ring grooves formed on the inner circumferential surface of pressure delivery body 40. These passages are then interconnected and exit pressure delivery body 40 at port 53. Port 53 is an interface for a pressurized fluid source (not shown) and typically includes a connector or receptacle for receiving a hose, tubing, or other delivery means from the pressurized fluid source. When pressurized fluid is supplied at port 53, fluid pressurization within delivery passage 52 compresses isolation seals 42 against the outer circumferential surface of rotatable shaft 30, as shown in FIG. 5.

While isolation seals 42 are in a compressed state, rotatable shaft 30 is rotationally fixed with respect to pressure delivery body 40. Rotatable shaft 30 may be fixed using mechanical means or may be disengaged from rotation mechanism of the machine tool in which linear actuator is being used.

Isolation seals 42 are typically O-rings made from an elastomeric material, such as rubber. One skilled in the art will recognize a number of different known materials having suitable properties to act as isolation seals 42 in the present invention. The size of isolation seals 42 is dependent upon the dimensions of pressure delivery body 40 and rotatable shaft 30. According to one embodiment of the invention, isolation seals 42 have an inside diameter that is 0.030" to 0.060" larger than the outside diameter of rotatable shaft 30.

Figure 6A:
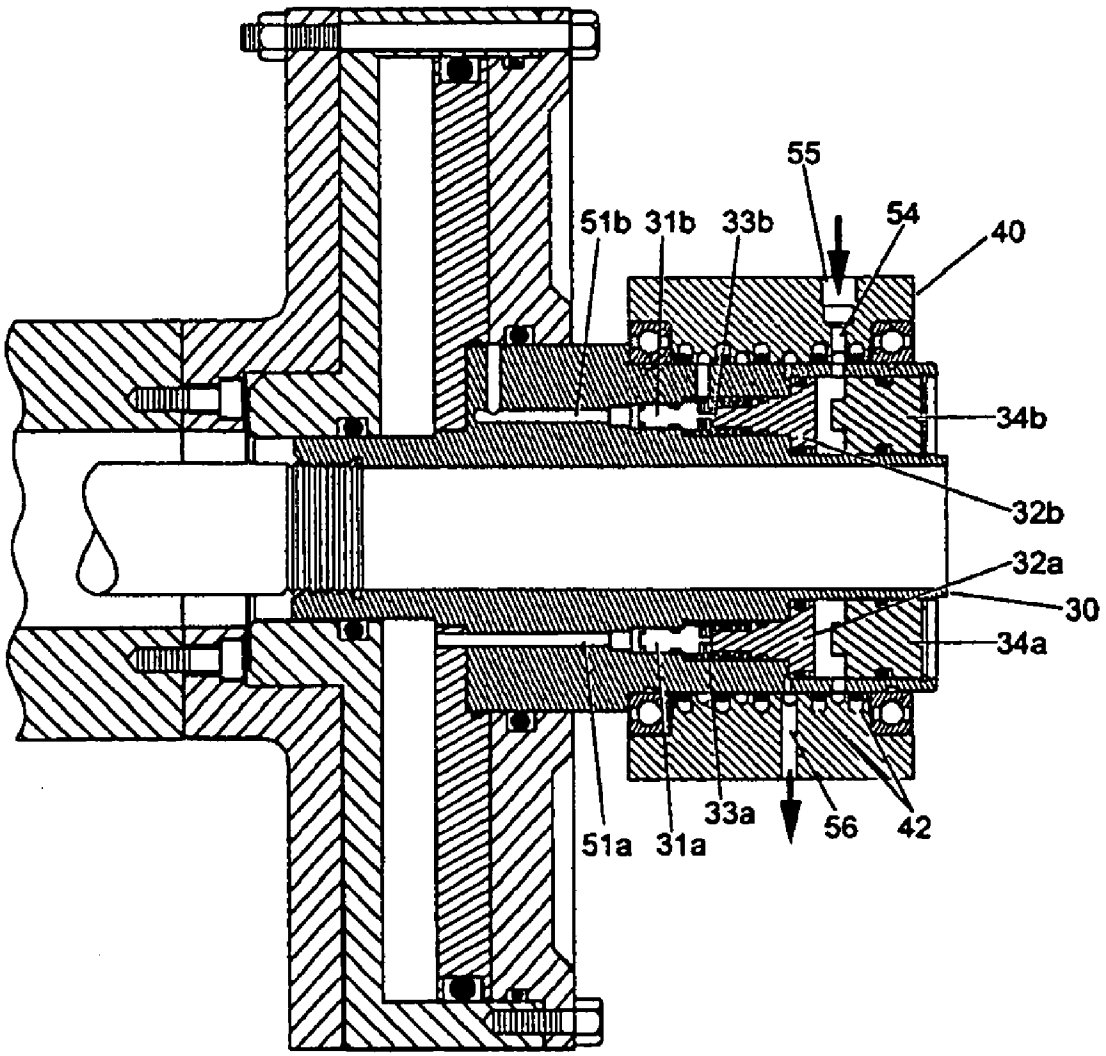
FIGS. 6A to 6C are cross-sectional views of a linear actuator according to one embodiment of the invention.

Once isolation seals 42 have been compressed in step S401, valves 31*a* and 31*b* are opened in step S402. FIG. 6A is a cross-sectional view of linear actuator 10 depicting valves 31*a* and 31*b* in an open state according to one embodiment of the invention. Valves 31*a* and 31*b* represented in FIG. 6A are pressure blocking valves such as standard Schrader replaceable tire valve cores which are opened when actuating pistons 32*a* and 32*b* slide into and depress the respective valve pins and are closed when actuating pistons 32*a* and 32*b* move away from and release the respective valve pins. Fluid pressurization of the chambers defined between actuating pistons 32*a* and 32*b* and end caps 34*a* and 34*b*, respectively, drives actuating pistons 32*a* and 32*b* in a linear direction towards valves 31*a* and 31*b*. When fluid pressure is released or vented from the chambers defined between the actuating pistons and the end caps, springs 33*a* and 33*b*, which are compressed when actuating pistons 32*a* and 32*b* are driven towards valves 31*a* and 31*b*, return actuating pistons 32*a* and 32*b* to their initial positions as shown in FIGS. 3 and 5. One skilled in the art will recognize that the invention is not limited to the use of Schrader replaceable tire valve cores and that alternative valve mechanisms may be used without departing from the scope of the invention.

Fluid pressurization of the chambers between actuating pistons 32*a* and 32*b* and end caps 34*a* and 34*b* is performed using delivery passage 54 and vent 56 defined in pressure delivery body 40. As shown in FIG. 6A, delivery passage 54 includes a passage that intersects with a ring groove formed on the inner circumferential surface of pressure delivery body 40 on one end of the passage and exits pressure delivery body 40 at port 55 on the other end. Similar to port 53, port 55 is an interface for a pressurized fluid source (not shown) and typically includes a connector or receptacle for receiving a hose, tubing, or other delivery means from the pressurized fluid source. Delivery passage 54 and the intersecting ring groove are isolated from the other ring grooves and associated passages in pressure delivery body 40 by the compressed isolation seals 42. The isolated ring groove interconnects the chambers defined between actuating pistons 32*a* and 32*b* and end caps 34*a* and 34*b*, respectively, and provides a path to deliver pressurized fluid to those chambers.

Figure 6C:
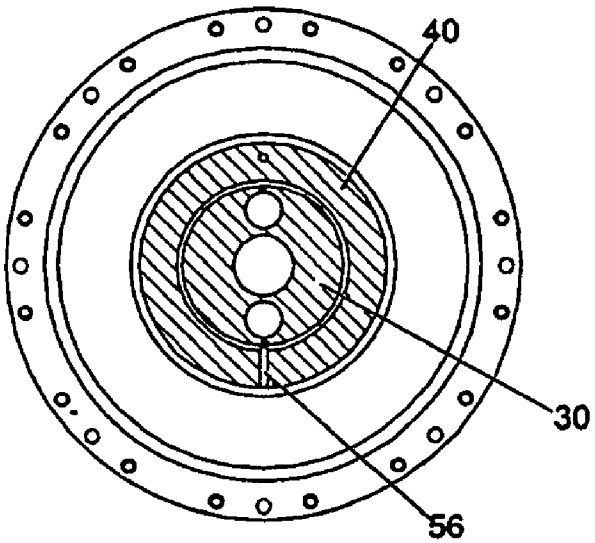
Figure 6B:
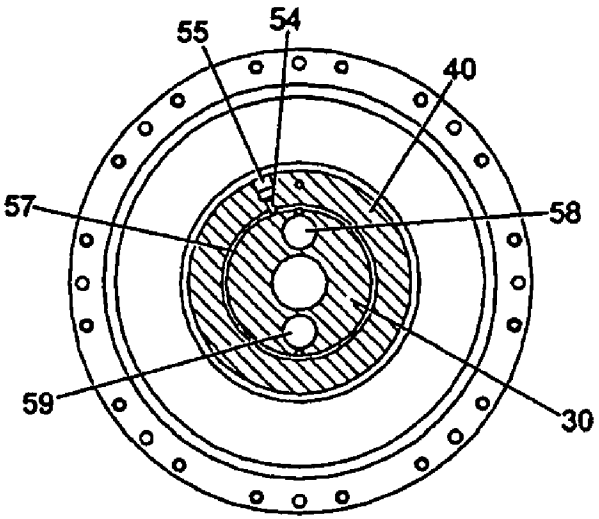

FIG. 6B is a cross-sectional view of linear actuator 10 depicting the fluid passages within rotatable shaft 30 and pressure delivery body 40 according to one embodiment of the invention. FIG. 6B depicts port 55, delivery passage 54 and ring groove 57 within pressure delivery body 40. Also shown in FIG. 6B are chambers 58 and 59 defined between actuating pistons 32*a* and 32*b* (not shown) and end caps 34*a* and 34*b* (not shown) in rotatable shaft 30. As described above, pressurized fluid is delivered from delivery passage 54 to chambers 58 and 59 via ring groove 57. The axial alignment of rotatable shaft 30 and pressure delivery body 40 is fixed at the time of assembly. Using the ring groove to deliver pressurized fluid removes the necessity to rotationally align rotatable shaft 30 and pressure delivery body 40 during operation of the linear actuator in order to deliver the pressurized fluid. Regardless of where rotatable shaft 30 is positioned rotationally, chambers 58 and 59 are always in fluid communication with ring groove 57, which is always in fluid communication with delivery passage 54.

As actuating pistons 32*a* and 32*b* are driven towards valves 31*a* and 31*b*, respectively, the displaced fluid between actuating pistons 32*a* and 32*b* and their respective piston cavities in rotatable shaft 30 is vented through vent 56. Similar to delivery passage 54, vent 56 includes a passage that intersects a ring groove formed on the inner circumferential surface of pressure delivery body 40. The ring groove is isolated from the other ring grooves and their associated passages by the compressed isolation seals 42. This isolated ring groove interconnects the spaces between actuating pistons 32*a* and 32*b* and valves 31*a* and 31*b*, respectively, and provides a path for fluid to be exhausted as actuating pistons 32*a* and 32*b* are driven. FIG. 6C depicts a cross-sectional view of linear actuator 10 depicting the fluid passages associated with vent 56.

Figure 7:
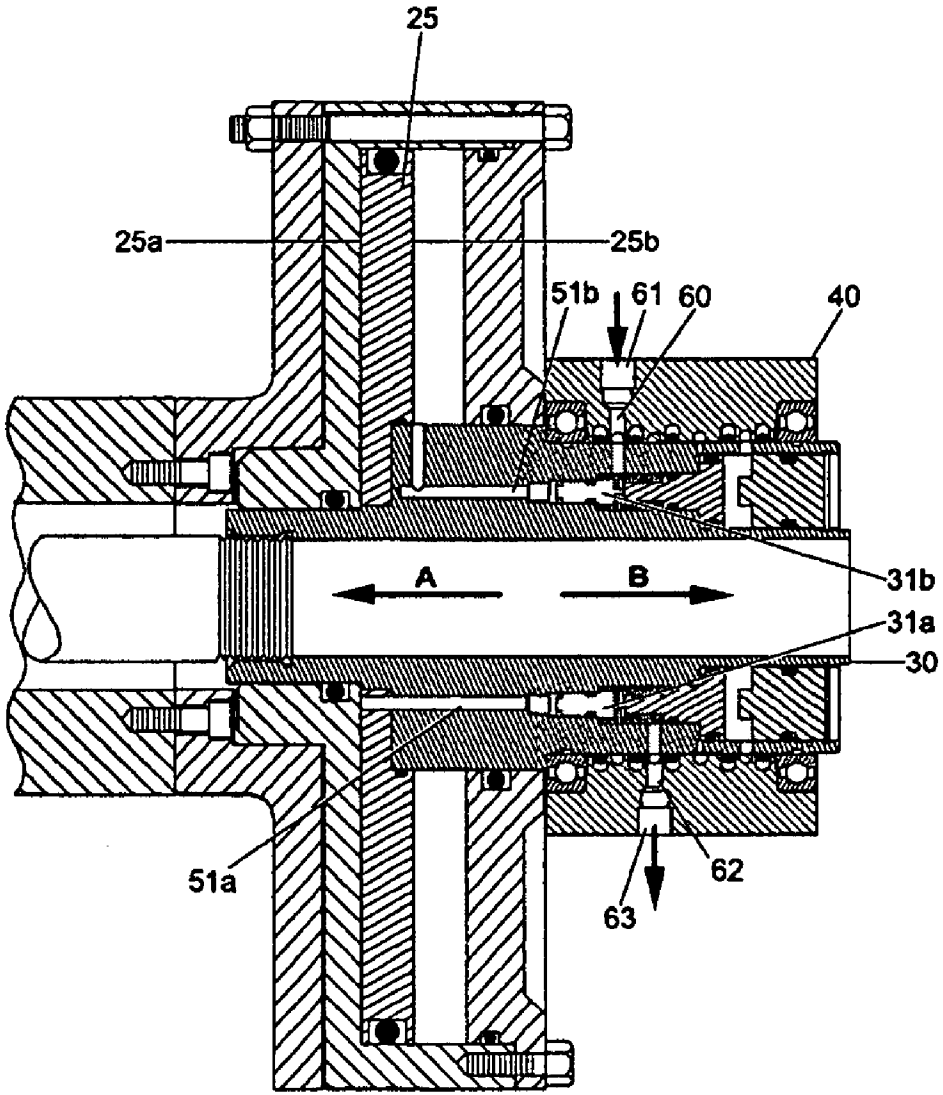
FIG. 7 is cross-sectional view of a linear actuator according to one embodiment of the invention.

After valves 31*a* and 31*b* are opened in step S402, rotatable shaft 30 is actuated in step S403. Actuation of rotatable shaft 30 is performed using fluid pressurization of the chambers delimited by primary piston 25 in the cavity defined by cylinder member 20. FIG. 7 depicts linear actuator 10 after rotatable shaft 30 has been actuated in step S403.

FIG. 7 is a cross-sectional view of linear actuator 10 depicting the fluid passages within rotatable shaft 30 and pressure delivery body 40 according to one embodiment of the invention. Referring to FIG. 7, the chamber delimited by the second face 25*b* of primary piston 25 is maximized by delivering a pressurized fluid through main passage 51*b*. Maximizing this chamber drives primary piston 25 in a first axial direction indicated by arrow A. As primary piston 25 is driven in this direction, rotatable shaft 30, which is fixed to primary piston 25, is actuated in the same axial direction. Pressurized fluid is supplied to main passage 51*b* through delivery passage 60 defined in pressure delivery body 40. Delivery passage 60 includes a passage that intersects a ring groove formed on the inner circumferential surface of pressure delivery body 40 on one end and exits pressure delivery body 40 at port 61 on the other end. Port 61 is an interface for a pressurized fluid source (not shown) and typically includes a connector or receptacle for receiving a hose, tubing, or other delivery means from the pressurized fluid source. The ring groove is isolated from the other ring grooves and associated passages by the compressed isolation seals 42. The arrangement of delivery passage 60 and the associated ring groove is similar to that shown in FIG. 6B for delivery passage 54. Valve 31*b* is positioned in main passage 51*b* at a location between delivery passage 60 and the chamber delimited by primary piston 25. In this manner, valve 31*b* controls fluid communication between delivery passage 60 and the chamber.

When the second chamber delimited by the second face 25*b* of primary piston 25 is maximized, the first chamber delimited by the first face 25*a* of primary piston 25 is minimized. During this process, displaced fluid from the first chamber is vented through main passage 51*a* and delivery passage 62. Delivery passage 62 includes a passage that intersects a ring groove formed on the inner circumferential surface of pressure delivery body 40 on one end and port 63 on the other end. Port 63 is an interface for a vent connection and may include a connector for a hose, tubing or other means to vent fluid away from the first chamber. The ring groove is isolated from the other ring grooves and associated passages by the compressed isolation seals 42. The arrangement of delivery passage 62 and the associated ring groove is similar to that shown in FIG. 6B for delivery passage 54. Valve 31*a* is positioned in main passage 51*a* at a location between delivery passage 62 and the first chamber delimited by primary piston 25. In this manner, valve 31*a* controls fluid communication between delivery passage 62 and the chamber.

The actuation of rotatable shaft 30 in a second axial direction indicated by arrow B in FIG. 7 is accomplished by switching the direction of fluid flow through delivery passages 60 and 62. Specifically, fluid pressurization of the first chamber delimited by the first face 25*a* of primary piston 25 by delivering pressurized fluid to the chamber via main passage 51*a* and delivery passage 62 will drive primary piston 25 and rotatable shaft 30 in the second axial direction. To achieve this reverse operation, switchable supply lines (not shown) are connected to ports 61 and 63. Using equipment and techniques known to those skilled in the art, these switchable supply lines are selectively operated to either vent fluid or supply pressurized fluid depending on the desired actuation direction.

In the embodiment depicted in FIG. 7, the range of linear motion provided by linear actuator 10 is dependent upon the dimensions of cylinder member 20 and primary piston 25. Typically, rotatable shaft 30 is actuated approximately 1" in an axial direction. As will be understood by one skilled in the art, this range can be modified by providing a cylinder member 20 defining a cavity that is either axially longer or shorter, depending on the desired change in motion. In addition, varying the thickness of primary piston 25 in the axial direction will change the range of linear motion provided by linear actuator 10.

Figure 8:
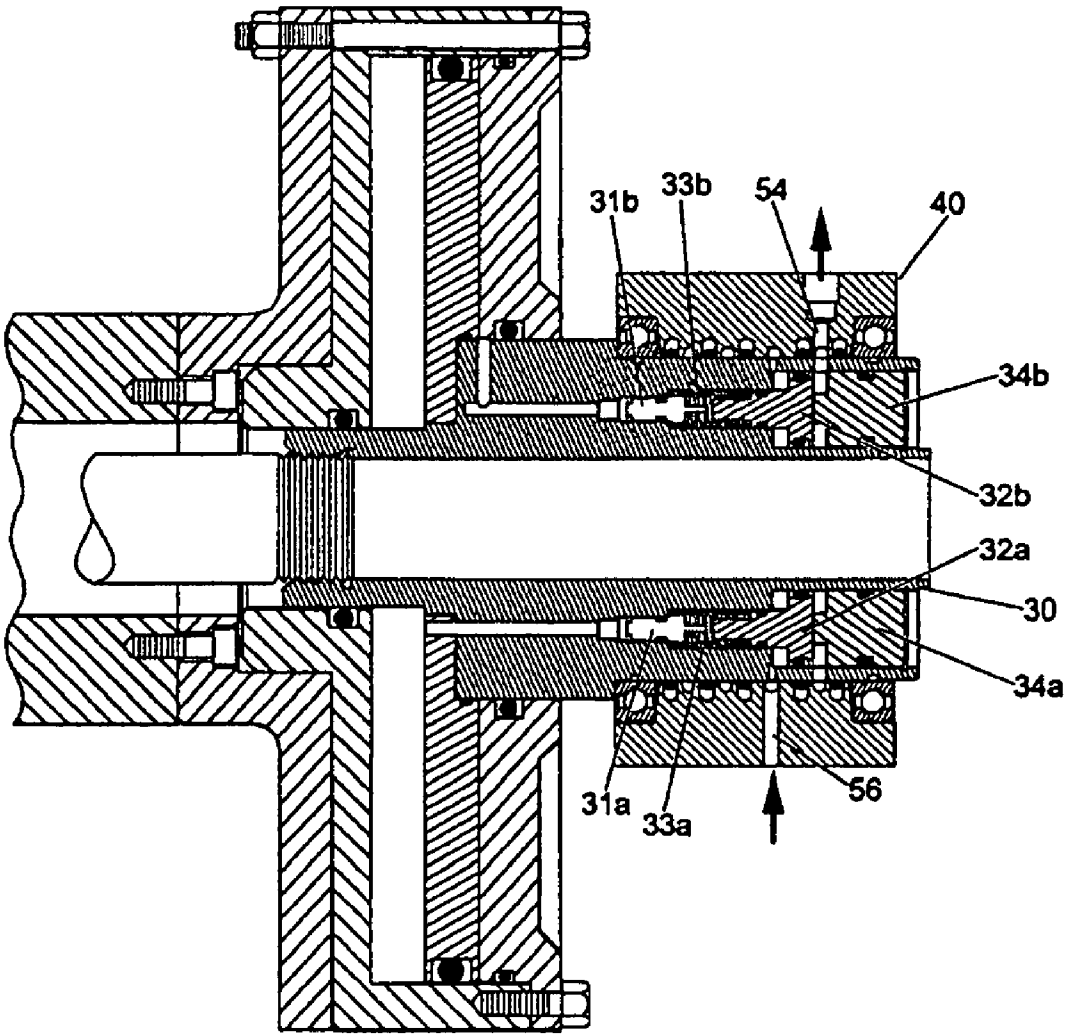
FIG. 8 is cross-sectional view of a linear actuator according to one embodiment of the invention.

In step S404, the fluid pressurization in the chambers delimited by primary piston 25 is maintained by closing valves 31*a* and 31*b*. FIG. 8 is a cross-sectional view of linear actuator 10 at the conclusion of step S404 according to one embodiment of the invention. Similar to the supply lines connected to ports 61 and 63, the supply line connected to port 55 is preferably a switchable supply line that is selectively operated to either vent fluid or supply pressurized fluid to delivery passage 54. While pressure is being maintained to the chambers delimited by primary piston 25, valves 31*a* and 31*b* are closed by selectively operating the supply line connected to port 55 as a vent to allow the pressurized fluid to be vented from the chambers between actuating pistons 32*a* and 32*b* and end caps 34*a* and 34*b*, respectively. As the pressurized fluid is vented, the compressed force of return springs 33*a* and 33*b* drives actuating pistons 32*a* and 32*b*, respectively, back to an initial position, as shown in FIG. 8. As actuating pistons 32*a* and 32*b* move away from valves 31*a* and 31*b*, the valve pins are released and valves 31*a* and 31*b* are closed. In this manner, fluid communication along main passages 51*a* and 51*b* is selectively blocked.

Figure 9:
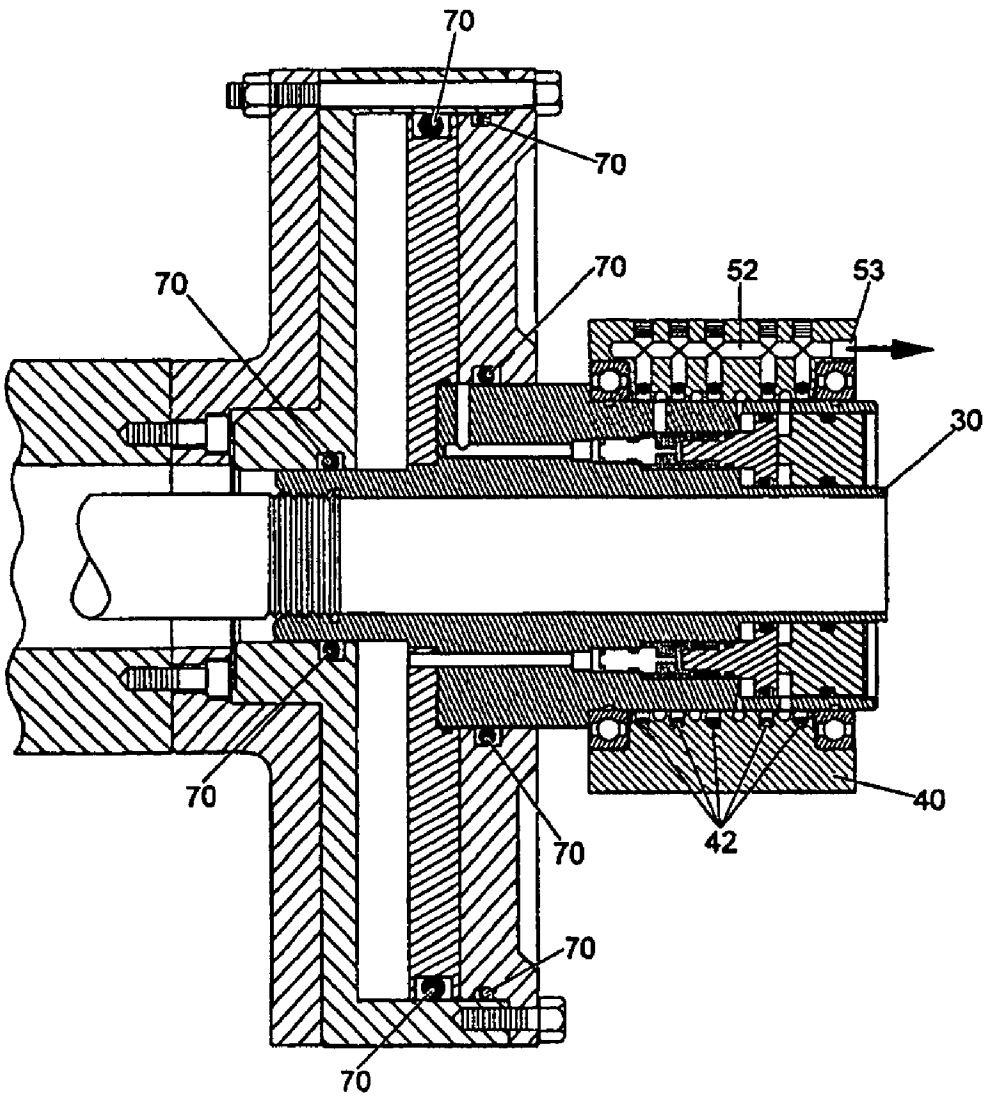
FIG. 9 is cross-sectional view of a linear actuator according to one embodiment of the invention.

Once valves 31*a* and 31*b* are closed, isolation seals 42 are released in step S405 by venting delivery passage 52. FIG. 9 is a cross-sectional view of linear actuator 10 after isolations seals 42 are released according to one embodiment of the invention. As with supply lines connected to the other ports in pressure delivery body 40, a supply line capable of being selectively operated as a fluid pressure source or vent is connected to port 53 to facilitate the ventilation of delivery passage 52. As the fluid pressurization in delivery passage 52 is vented, isolation seals 42 expand back into their respective ring grooves and separate from the outer circumferential surface of rotatable shaft 30. In this state, rotatable shaft 30, together with primary piston 25 and cylinder member 20, is free to rotate within pressure delivery body 40.

Fluid pressurization in the chambers within cylinder member 20 is maintained by valves 31*a* and 31*b* as well as various seals included at sliding interfaces within linear actuator 10. For example, seals 70 are positioned between primary piston 25 and cylinder wall 21, between cylinder wall 21 and cylinder base 22, between cylinder wall 21 and rotatable shaft 30, etc. The ability to maintain pressure within the chambers allows the rotatable shaft 30 to be actuated in the axial direction and rotated without requiring a constant pressure supply, as used in conventional devices. Seals 70 are typically O-rings formed of rubber or similar materials. However, the invention is not limited to O-rings and may be implemented using other sealing mechanisms known to those skilled in the art.

The speed at which rotatable shaft 30 rotates varies depending on the application requirements. In lathe applications, the rotational speed is typically between 4,000 and 6,000 rpm. This range will vary depending on the material of the work piece being supported and the type of machining processes being employed. One skilled in the art will understand that the scope of the invention is not limited to a particular range of rotational speed.

The foregoing description has referenced the use of pressurized fluids to operate the linear actuator. According to one embodiment of the invention, the fluid is air. However, one skilled in the art will recognize that the scope of the invention includes other fluids such as different gases or various liquids suitable for pneumatic and hydraulic applications. In addition, various lubricants may be mixed with a gaseous fluid in certain embodiments of the invention.

Using an air compressor with one or more regulators, the air pressure is varied for different applications. For example, the amount of air pressure required to compress the isolations seals against the rotatable shaft may differ from the amount of air pressure needed to actuate the rotatable shaft. The amount of air pressure needed to actuate the rotatable shaft will depend on the material of the work piece being supported and the degree of machining to be performed on the work piece. For example, relative weak materials will require less pressure to be supported in order to avoid damaging the work pieces. Relatively stronger materials will require more pressure to be supported against the strains made by the machining processes performed. Air pressures applied to the linear actuator of the present invention typically range from 20 to 100 psi, but may be expanded beyond this range for particular applications.

The various components of linear actuator 10 described above can be made from various materials without departing from the scope of the invention. As with the amount of air pressure applied, the types of materials used to form the components will vary depending on the requirements of the application. Typically, components such as the cylinder member, the primary piston and the pressure delivery body are made of metals or alloys such as steel, aluminum, brass, etc. One skilled in the art will recognize that a number of different materials can be used to implement the invention without departing from the scope thereof.

The foregoing description is provided to enable one skilled in the art to practice the various embodiments of the invention described herein. Various modifications to these embodiments will be readily apparent to those skilled in the art, and generic principles defined herein may be applied to other embodiments. Thus, the following claims are not intended to be limited to the embodiments of the invention shown and described herein, but are to be accorded the full scope consistent with the language of the claims. All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A linear actuator for a rotating shaft assembly, comprising:

a cylinder member;

a primary piston arranged within a cavity defined by said cylinder member, wherein a first face of said primary piston delimits a first chamber within the cavity and a second face of said primary piston delimits a second chamber within the cavity;

a rotatable shaft fixed to said primary piston, said rotatable shaft defining a first main passage in fluid communication with the first chamber and defining a second main passage in fluid communication with the second chamber;

a pressure delivery body fixed to said rotatable shaft, said pressure delivery body defining a first delivery passage in fluid communication with the first main passage and defining a second delivery passage in fluid communication with the second main passage, wherein said pressure delivery body comprises a passage isolation system for selectively isolating fluid communication between the first delivery passage and the first main passage and fluid communication between the second delivery passage and the second main passage; and a pressure limiting system for selectively blocking fluid communication through the first main passage and the second main passage, wherein said primary piston, said rotatable shaft and said pressure delivery body are axially movable with respect to said cylinder member, and said cylinder member, said primary piston and said rotatable shaft are rotationally movable with respect to said pressure delivery body, wherein fluid pressurization of the first chamber actuates said rotatable shaft in a first axial direction, and blocking fluid communication through the first main passage after fluid pressurization substantially maintains the actuation of said rotatable shaft in the first axial direction, and wherein fluid pressurization of the second chamber actuates said rotatable shaft in a second axial direction, and blocking fluid communication through the second main passage after fluid pressurization substantially maintains the actuation of said rotatable shaft in the second axial direction.

2. The linear actuator according to claim 1, wherein said rotatable shaft extends through an axial opening in a proximal end of said cylinder member, through an axial opening in said primary piston, and into an axial opening in a distal end of said cylinder member.

3. The linear actuator according to claim 1, wherein the passage isolation system comprises:

a plurality of elastomeric seals arranged in respective ring grooves formed in an inner circumferential surface of said pressure delivery body adjacent to an outer circumferential surface of said rotatable shaft, wherein the ring grooves are positioned adjacent to and between the first and second delivery passages; and a third delivery passage defined in said pressure delivery body, the third delivery passage in fluid communication with the ring grooves, wherein fluid pressurization of the third delivery passage engages the plurality of elastomeric seals against the outer circumferential surface of said rotatable shaft thereby isolating fluid communication between the first delivery passage and the first main passage and fluid communication between the second delivery passage and the second main passage.

4. The linear actuator according to claim 3, wherein said plurality of elastomeric seals are O-rings.

5. The linear actuator according to claim 1, wherein said pressure delivery body is fixed to said rotatable shaft with a plurality of bearings.

6. The linear actuator according to claim 5, wherein the plurality of bearings are rolling element bearings.

7. The linear actuator according to claim 1, wherein said pressure limiting system comprises:

a first valve arranged in the first main passage;

a first actuator for selectively opening and closing said first valve;

a second valve arranged in the second main passage; and a second actuator for selectively opening and closing said second valve.

8. The linear actuator according to claim 7, wherein each of said first and second actuators comprises an actuating piston arranged within a cavity defined by said rotatable shaft, wherein a face of said actuating piston delimits an actuation chamber within the cavity defined by said rotatable shaft, wherein said pressure delivery body further defines a fourth delivery passage in fluid communication with the actuation chamber, wherein the passage isolation system of said pressure delivery body selectively isolates fluid communication between the fourth delivery passage and the actuation chamber, and wherein fluid pressurization of the actuation chamber actuates the actuating piston in the first axial direction thereby opening the valve.

9. The linear actuator according to claim 8, wherein each of said first and second actuators further comprises a spring arranged within the cavity defined by said rotatable shaft, wherein said spring is positioned to drive the actuating piston in the second axial direction to an initial position under a non-pressurization condition within the actuation chamber.

10. The linear actuator according to claim 7, wherein said first and second valves are pressure blocking valves.

11. The linear actuator according to claim 7, wherein said first and second valves are Schrader replaceable tire valve cores.

12. The linear actuator according to claim 1, wherein said rotatable shaft comprises a mount for attaching a component to said rotatable shaft.

13. The linear actuator according to claim 12, wherein said mount comprises a threaded receptacle.

14. The linear actuator according to claim 12, wherein the component comprises a chuck.

* * * * *